US010910727B2

(12) United States Patent
Cohen et al.

(10) Patent No.: US 10,910,727 B2
(45) **Date of Patent: *Feb. 2, 2021**

(54) VIVALDI HORN ANTENNAS INCORPORATING FPS

(71) Applicant: Fractal Antenna Systems, Inc., Bedford, MA (US)

(72) Inventors: Nathan Cohen, Belmont, MA (US); Ryan Thistle, Waltham, MA (US); Daniel Earle, Waltham, MA (US); Philip Salkind, Boston, MA (US); A. J. Shelman-Cohen, Belmont, MA (US)

(73) Assignee: Fractal Antenna Systems, Inc., Bedford, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/701,603

(22) Filed: Dec. 3, 2019

(65) Prior Publication Data

US 2020/0106186 A1 Apr. 2, 2020

Related U.S. Application Data

(63) Continuation of application No. 16/216,830, filed on Dec. 11, 2018, now Pat. No. 10,498,040.

(Continued)

(51) Int. Cl.
*H01Q 13/10* (2006.01)
*H01Q 13/08* (2006.01)

(Continued)

(52) U.S. Cl.
CPC ..... *H01Q 13/085* (2013.01); *H01Q 15/0093* (2013.01); *H01Q 21/064* (2013.01); *H01Q 1/241* (2013.01)

(58) Field of Classification Search
CPC .... H01Q 13/00–13/10; H01Q 15/0093; H01Q 21/064

(Continued)

(56) References Cited

U.S. PATENT DOCUMENTS 4,853,704 A * 8/1989 Diaz ..... H01Q 13/085 343/767
4,855,749 A 8/1989 DeFonzo (Continued)

FOREIGN PATENT DOCUMENTS

CN 103985944 4/2016

OTHER PUBLICATIONS

International Search Report and Written Opinion dated May 14, 2019 for International Application No. PCT/US19/17969 filed Feb. 14, 2019 for Fractal Antenna Systems, Inc., 12 pages.

(Continued)

*Primary Examiner* — Hasan Z Islam
(74) *Attorney, Agent, or Firm* — Cesari and McKenna, LLP

(57) ABSTRACT

Vivaldi tapered slot and Vivaldi horn antennas that feature or include fractal plasmonic surfaces ("FPS") are described. Vivaldi slot antennas are described which include a conductive surface defining a tapered slot, with the conductive surface including a plurality of fractal resonators which form or constitute a fractal plasmonic surface (FPS). In some embodiments the fractal resonators can be defined by slots. In some embodiments the fractal resonators can include self-complementary features. In exemplary embodiments, two Vivaldi horn antennas may be used for a Vivaldi horn antenna. The two Vivaldi FPS antennas can be arranged in a crossed or cross configuration such that the two antennas are essentially perpendicular to one another and are therefore able to receive and transmit two orthogonal polariza- (Continued)

tions of radiation. The two antennas can be fed by separate respective feed lines. The two antennas can be mounted inside of a horn or casing.

19 Claims, 10 Drawing Sheets

Related U.S. Application Data

(60) Provisional application No. 62/710,349, filed on Feb. 17, 2018, provisional application No. 62/764,083, filed on Jul. 18, 2018, provisional application No. 62/756,301, filed on Nov. 6, 2018.

(51) Int. Cl.
*H01Q 21/06* (2006.01)
*H01Q 15/00* (2006.01)
*H01Q 1/24* (2006.01)

(58) Field of Classification Search
USPC ..... 343/767–770
See application file for complete search history.

(56) References Cited

U.S. PATENT DOCUMENTS

| | | | | |
|---|---|---|---|---|
| 5,036,335 | A | 7/1991 | Jairam | |
| 5,081,466 | A * | 1/1992 | Bitter, Jr. | H01Q 13/085 343/767 |
| 5,519,408 | A | 5/1996 | Schnetzer | |
| 6,043,785 | A | 3/2000 | Marino | |
| 6,414,645 | B1 * | 7/2002 | Dahlberg | H01Q 1/283 343/705 |
| 7,088,300 | B2 * | 8/2006 | Fisher | H01Q 13/085 343/767 |
| 7,498,995 | B2 | 3/2009 | Kim | |
| 8,269,685 | B2 * | 9/2012 | McQuaid | H01Q 1/38 343/767 |
| 8,279,128 | B2 | 10/2012 | McQuaid | |
| 10,374,317 | B2 | 8/2019 | Cheung | |
| 2005/0012672 | A1 | 1/2005 | Fisher | |
| 2008/0084352 | A1 | 4/2008 | Piskun | |
| 2011/0095955 | A1 | 4/2011 | Cohen | |

OTHER PUBLICATIONS

International Preliminary Report on Patentability dated Aug. 18, 2020 for PCT/US2019017969 filed Feb. 14, 2018 for Fractal Antenna Systems, Inc., 4 pages.

* cited by examiner

400

VIVALDI HORN ANTENNAS INCORPORATING FPS

CROSS-REFERENCE TO RELATED APPLICATIONS

The present application is a continuation of U.S. patent application Ser. No. 16/216,830, filed Dec. 11, 2018 and entitled "Vivaldi Horn Antennas Incorporating FPS," which issued as U.S. Pat. No. 10,498,040, and which claims the benefit of and priority to the following applications: U.S. Provisional Patent Application No. 62/756,301, filed Nov. 6, 2018, and entitled "Vivaldi Horn Antennas Incorporating FPS,"; U.S. Provisional Patent Application No. 62/764,083, filed Jul. 18, 2018, and entitled "Vivaldi Horn Antenna Incorporating Fractal Plasmonic Surfaces,"; and, U.S. Provisional Patent Application No. 62/710,349 filed Feb. 17, 2018, and entitled "Fractal Metamaterial Enhanced Vivaldi Antenna,"; each of which applications is hereby incorporated by reference herein in its entirety.

BACKGROUND

Wideband tapered slot and horn antennas—commonly known as "Vivaldi slot" or "Vivaldi horn antennas"—are known as having an advantage of wideband bandwidth, often 10:1 or more bandwidth, with the ability to superpose a second Vivaldi antenna at a right angle, thereby capturing two orthogonal polarizations of electromagnetic waves. Examples of prior Vivaldi antennas are shown and described in U.S. Pat. Nos. 6,043,785, 5,519,408, 5,036,335, and 4,855,749, among others.

FIG. 1, derived from U.S. Pat. No. 5,036,335, shows an exponentially tapered slot Vivaldi antenna 102 defined by a metallized layer 105 on one main face of a substrate 104. The antenna 102 has a conventional feed arrangement comprising a stripline defined by a narrow conductor 101 (dotted) on one main face of the substrate 104 and a slot line 103 extending from the narrower end of the slot antenna 102 to form a balun by crossing over one another at right angles at a point D. The strip line 101 terminates in an open-circuit and extends beyond the slot line 103 by a distance $\lambda_m/4$. The slot line 103 terminates in a short-circuit and extends beyond the stripline 101 by a distance $\lambda_m/4$. The wavelengths $\lambda_m$ and $\lambda_m$ are respectively the guide wavelength in the stripline 101 and the slot line 103 at the operating frequency of the antenna. Thus, at the cross over point D the stripline 101 is effectively short-circuit and the slot line 103 is effectively open-circuit. This form of balun has been observed to have an inherent narrow bandwidth characteristic.

FIG. 2 shows a photograph or photo-based drawing of a prior-art Vivaldi slot antenna 200 similar to that depicted in FIG. 1. As shown, the Vivaldi slot antenna 200 includes a conductive surface 202 defining a tapered (exponentially) slot 204. Feed line 206 is shown along with stub termination 208, which can be used for impedance matching.

A significant disadvantage of Vivaldi antennas is that they have a large size which often makes them unwieldy, impractical, or unusable for many applications, particularly those where size or form factor is a primary consideration or design constraint. At lower frequencies of operation, with commensurate longer wavelengths, the requisite size of a typical Vivaldi antenna is driven upwards. Such increases in size may be deleterious or impossible to accommodate for some antenna applications. Prior art Vivaldi antennae have also been observed to suffer from degraded gain performance at the low end of their operational passbands.

SUMMARY

The present disclosure is directed to systems, components, and techniques that provide for Vivaldi tapered slot and Vivaldi horn antennas that feature or include fractal plasmonic surfaces ("FPS").

One aspect of the present disclosure provides Vivaldi slot antennas that include a conductive surface defining a tapered slot, with the conductive surface including a plurality of fractal resonators which form or constitute a fractal plasmonic surface (FPS). In some embodiments the fractal resonators can be defined by slots. In some embodiments the fractal resonators can include self-complementary features.

In exemplary embodiments, two Vivaldi horn antennas may be used for a Vivaldi horn antenna. The two Vivaldi FPS antennas can be arranged in a crossed or cross configuration such that the two antennas are essentially perpendicular to one another and are therefore able to receive and transmit two orthogonal polarizations of radiation. The two antennas can be fed by separate respective feed lines. The two antennas can be mounted inside of a horn or casing, e.g., arranged along the diagonals of the rectangular horn or casing.

It should be understood that other embodiments of systems, components, and methods according to the present disclosure will become readily apparent to those skilled in the art from the following detailed description, wherein exemplary embodiments are shown and described by way of illustration. The systems, components, and methods of the present disclosure are capable of other and different embodiments, and details of such are capable of modification in various other respects. Accordingly, the drawings and detailed description are to be regarded as illustrative in nature and not as restrictive. These, as well as other components, steps, features, objects, benefits, and advantages, will now become clear from a review of the following detailed description of illustrative embodiments, the accompanying drawings, and the claims.

BRIEF DESCRIPTION OF THE DRAWINGS

The drawings are of illustrative embodiments. They do not illustrate all embodiments. Other embodiments may be used in addition or instead. Details that may be apparent or unnecessary may be omitted to save space or for more effective illustration. Some embodiments may be practiced with additional components or steps and/or without all of the components or steps that are illustrated. When the same numeral appears in different drawings, it refers to the same or like components or steps. Aspects of the disclosure may be more fully understood from the following description when read together with the accompanying drawings, which are to be regarded as illustrative in nature, and not as limiting. The drawings are not necessarily to scale, emphasis instead being placed on the principles of the disclosure. In the drawings.

Figure 1:
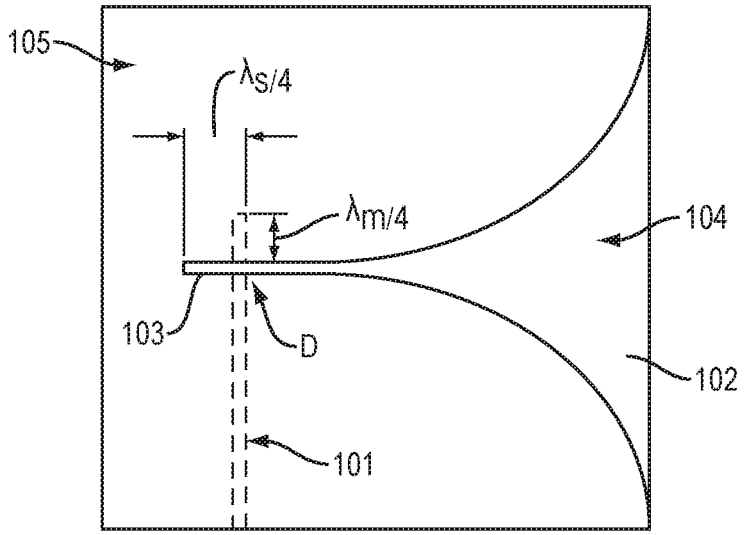
FIG. 1 (PRIOR ART)
FIG. 1 depicts an example of a prior art Vivaldi antenna.

While certain embodiments are depicted in the drawings, one skilled in the art will appreciate that the embodiments depicted are illustrative and that variations of those shown, as well as other embodiments described herein, may be envisioned and practiced within the scope of the present disclosure.

DETAILED DESCRIPTION

Illustrative embodiments are now described. Other embodiments may be used in addition or instead. Details that may be apparent or unnecessary may be omitted to save space or for a more effective presentation. Some embodiments may be practiced with additional components or steps and/or without all of the components or steps that are described.

An aspect of the present disclosure is directed to and provides an antenna or antennas, which incorporate a metamaterial or metamaterials, which changes the performance characteristics of the Vivaldi antenna(s), such as gain, frequency coverage, and SWR. For example, the passband cutoff may be substantially lowered, thus allowing a much smaller sized antenna if the original low end of the passband is desired. In exemplary embodiments, a fractal plasmonic surface is used for the metamaterial.

In exemplary embodiments, a fractal metamaterial comprises a plurality of fractal shapes, the fractal shapes constituting "cells" (resonators) that are electrically closely-spaced, e.g., less than 1/10, 1/12, 1/16, or 1/20 of wavelength of separation for the lowest operational frequency of use. A fractal can be considered as a self-similar figure with two or more iterations of a motif. The cells may vary their scale across some or all of the plurality. At least a portion of the antenna evinces (holds or includes) the fractal metamaterial.

Figure 3:
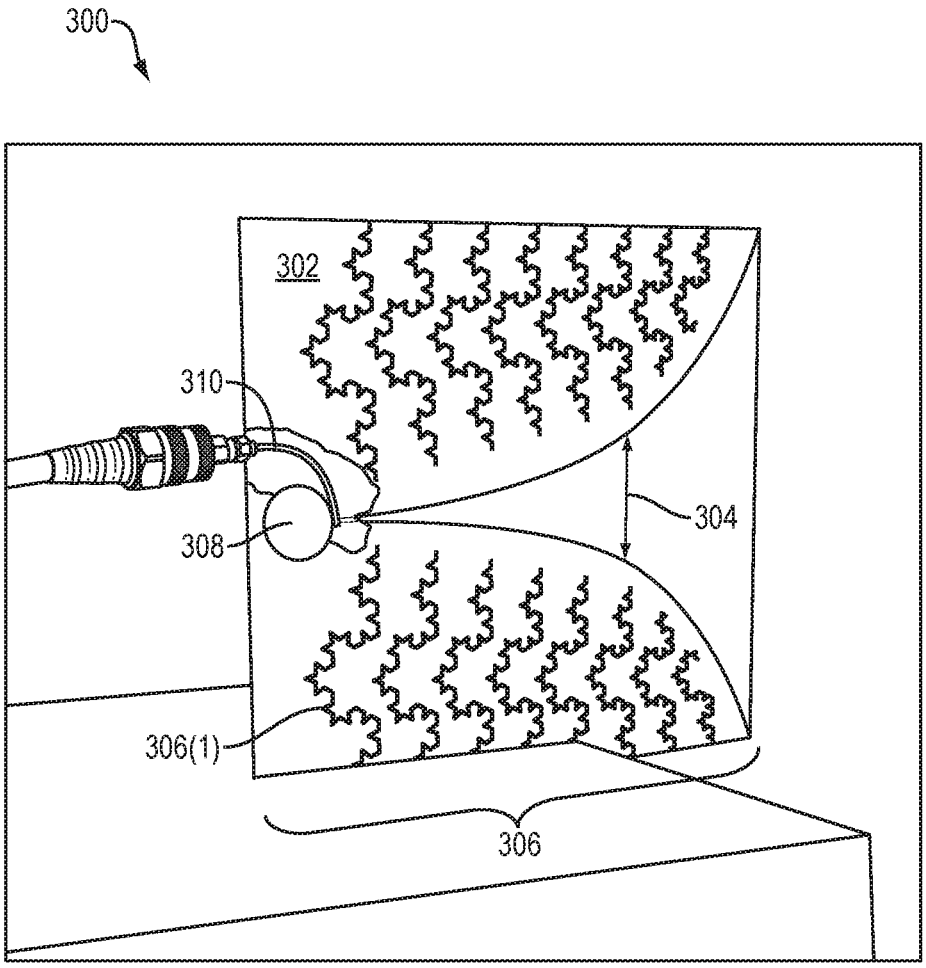
FIG. 3 depicts an example of a Vivaldi FPS antenna, in accordance with exemplary embodiments of the present disclosure.

FIG. 3 depicts Vivaldi FPS antenna 300, in accordance with an exemplary embodiment of the present disclosure. Vivaldi FPS antenna 300 includes a conductive structure, or surface, 302 defining a tapered slot 304, which is shown as having a shape of an exponential curve. A plurality of fractal cells 306 are disposed in the conductive surface 302 on first and second sides of the tapered slot 304. The slot 304 may terminate in an impedance matching shape or stub 308, which is shown as being circular in the drawing; in alternate embodiments, stub 308 may have a fractal or fractalized outline, shape, or perimeter. Conductive surface 302 may be made of any suitable conductive material, e.g., copper, silver ink, etc. In some embodiments, conductive surface 302 may be disposed on a suitable substrate (e.g., shown as lighter area surrounding 304 in FIG. 3), e.g., a dielectric substrate such as FR4, Rogers RO3206, fiberglass, Alumina, low temperature co-fired ceramic (LTCC), and the like.

In exemplary embodiments, Vivaldi FPS antenna according to the present disclosure, e.g., antenna 300, include fractal resonators having a shape that is substantially a deterministic fractal, e.g., of iteration order N≥2. Using fractal geometry, each of the antenna resonators has a self-similar structure resulting from the repetition of a design or motif (or "generator") that is replicated using rotation, and/or translation, and/or scaling. Alternate embodiments can utilize non-deterministic fractal shapes for fractal resonators and features.

Figure 2:
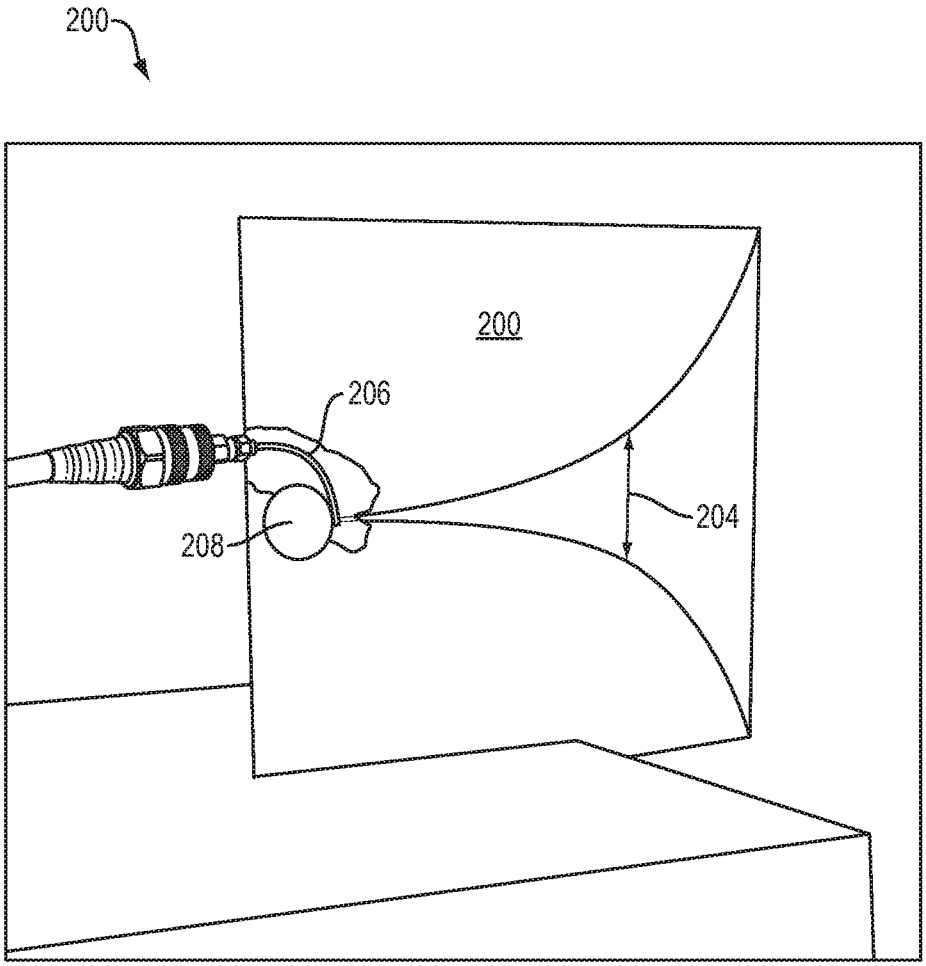
FIG. 2 (PRIOR ART)
FIG. 2 depicts a second example of a prior art Vivaldi antenna.
Figure 4:
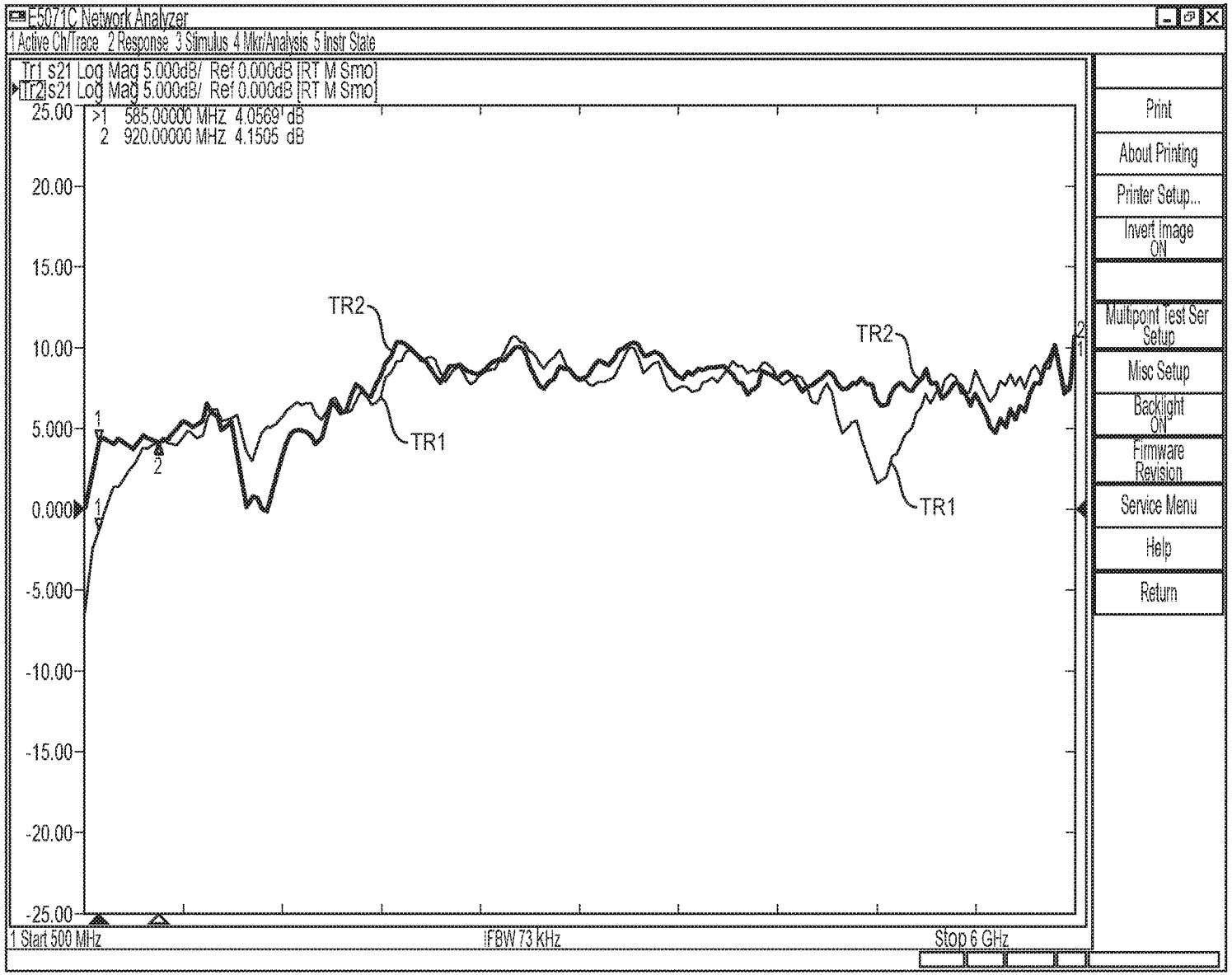
FIG. 4 is a plot showing performance benefits of the Vivaldi FPS antenna of FIG. 3 compared to the prior art Vivaldi antenna of FIG. 2.

FIG. 4 shows a comparison of the gain of the Vivaldi FPS antenna 300 of FIG. 3 with that of the conventional prior art Vivaldi antenna 200 shown in FIG. 2. As shown, the gain of the Vivaldi FPS antenna (FIG. 3) has a lowered passband (i.e., a low-frequency shoulder starting at a lower frequency) compared to the conventional (non-fractal) Vivaldi antenna of the same form factor. The gain of the prior-art Vivaldi antenna 200 is shown as Trace 1 (TR1); and the gain of the Vivaldi FPS antenna 300 is shown as Trace 2 (TR2).

As noted previously, a principle limitation of prior art Vivaldi horn antennas is the large required size necessary to accommodate the lower frequency of the desired spectrum of operation. At this low end of the spectrum, the antenna must maintain a substantial fraction of a wavelength in size at those frequencies, which sets the physical size of the Vivaldi horn antenna.

Embodiments of the present disclosure address and overcome the size problem by substantially shrinking the size of the Vivaldi horn antenna by utilizing fractal resonators, thereby affording a novel antenna having a profound practical benefit relative to prior art antennas, producing a smaller size antenna for equivalent or very similar performance. A Vivaldi FPS horn antenna can utilize a portion of a fractal plasmonic surface on the planar configuration of the Vivaldi horn—e.g., the V-like section—which produces a delay in the travel time at lower frequencies, thereby producing electromagnetic performance with the equivalent characteristics of a much larger antenna.

It will be appreciated that the fractal plasmonic surface may be manifest in a number of different geometric but fractal-based shapes. Examples include but are not limited to Sierpinski gasket or carpet geometries, Minkowski curves, Koch square or snowflake geometries, torn square, Mandelbrot, Caley tree, monkey's swing, and Cantor gasket geometry. The resonators may be closed loops which are fractal, or dipole like configurations which are fractal, or any variety of space filling or a lacunar structure. Thus the performance characteristics described for Vivaldi FPS horn antennae may be accomplished in many varying degrees by a variety of fractals incorporated in the fractal plasmonic surfaces, with various placements on the Vivaldi FPS horn. These may also include placement or inclusion of a FPS on the outer support structure, or horn, itself.

Figure 5:
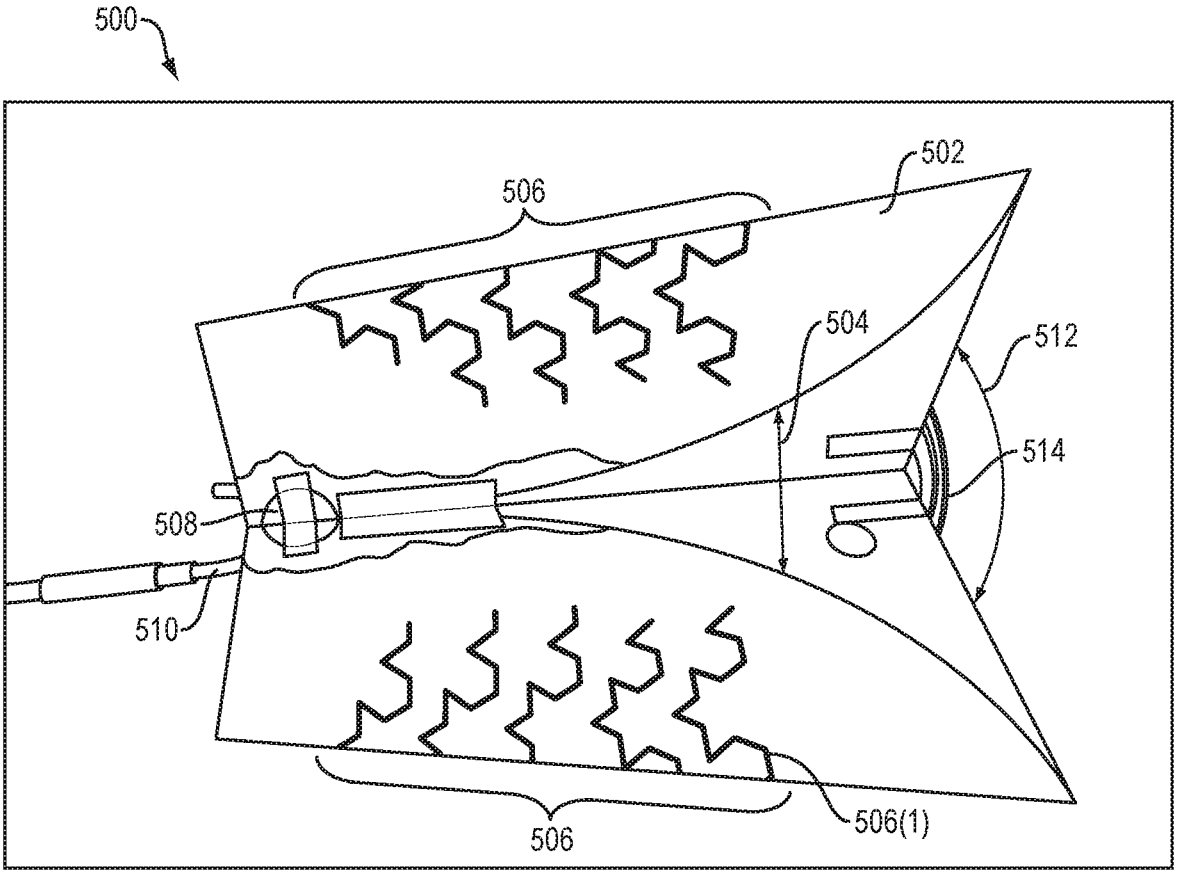
FIG. 5 depicts another example of a Vivaldi FPS antenna with a crossed configuration, in accordance with exemplary embodiments of the present disclosure.

FIG. 5 depicts an example of a Vivaldi FPS horn antenna 500, in accordance with exemplary embodiments of the present disclosure. As shown, antenna 500 includes two Vivaldi FPS tapered slot antennas 502(1)-(2) having conductive surfaces 503(1)-(2). One edge 504 of the conductive surface 503(1) of slot antenna 502(1) is shown for perspective. Each of the conductive surfaces 503(1)-503(20 incorporates fractal plasmonic surfaces configured as slots 506. The Vivaldi FPS slot antennas are 502(1)-(2) configured in a crossed arrangement such that they are substantially perpendicular (normal) to one another, as shown. The slots (e.g., 504) may terminate in an impedance matching shape or stub 508, which is shown as being circular in the drawing; in alternate embodiments, stub 508 may have a fractal or fractalized outline, shape, or perimeter. The two Vivaldi antennas 502(1)-(2) shown are separately fed and are held together (sandwiched) at right angles 512, e.g., by support structure 514. Support structure 514 may be made of any suitable material, e.g., plastic or other durable non-conductive material. It will be appreciated that in alternate embodiments, the FPS may be traces or areas, not slots in substrate.

With continued reference to FIG. 5, the dark area shown (i.e., conductive surface 503(1)-(2)) is a covering of a conductive copper circuit board on an insulating substrate; other suitable conductive materials may be used. The frequency coverage for the Vivaldi horn FPS antenna shown is 600-10,000 MHz and the form factor of the antenna is within a volume of 10 inches by 10 inches by 10 inches (i.e., a cube 10 inches on a side). This is compared to a conventional prior art Vivaldi horn of dimensions 19 inches by 14 inches by 14 inches required to cover a similar operational bandwidth.

Figure 6:
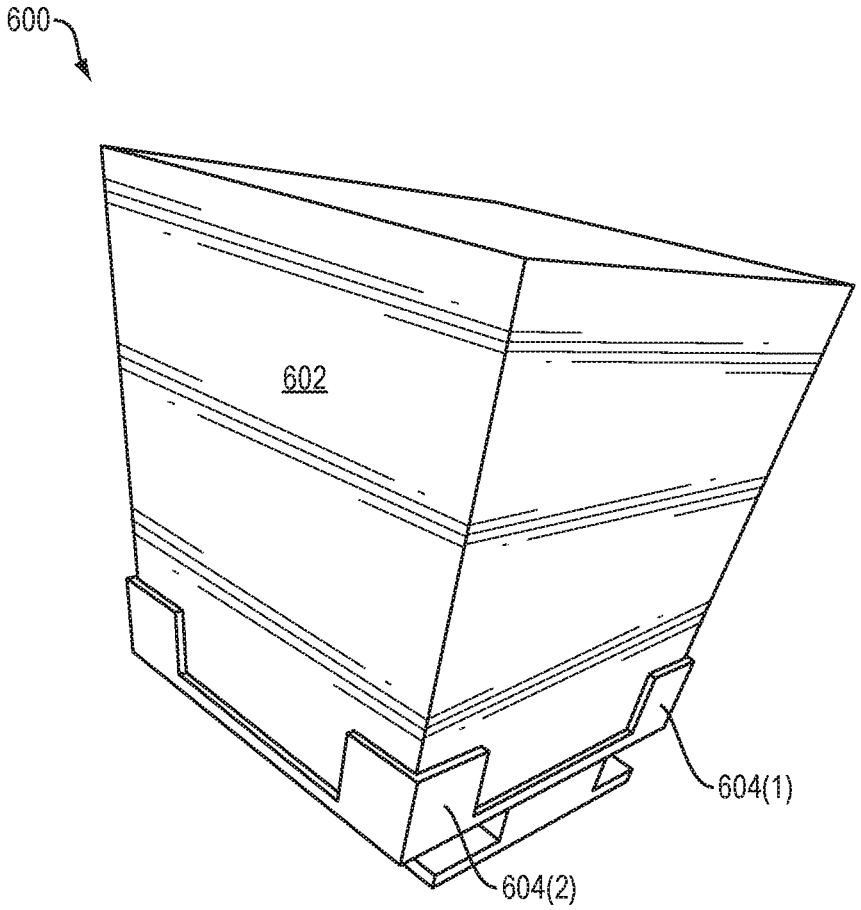
FIG. 6 depicts a horn or cone used for a Vivaldi FPS horn antenna, in accordance with exemplary embodiments of the present disclosure.

FIG. 6 depicts a conductive horn or cone 600 operative as a waveguide for use with Vivaldi FPS antennas according to exemplary embodiments of the present disclosure. Cone 600 includes an outer surface 602, which can be composed of multiple panels joined together. Structural supports 604(1)-(2) can be used facilitate joining of the panels. In preferred embodiments, a crossed-configuration antenna such as shown in FIG. 5 can be placed within or partially within cone 600.

In exemplary embodiments of Vivaldi FPS antenna, the antenna(s) may include self-complementary features (surfaces and/or three-dimensional shapes), or self-complementary spacing between one or more of the resonators. Self-complementarity is a geometric description well known and defined in the antenna art. See for example, "Self-Complementary Antennas," by Yasuto Mushiake, Springer-Verlag 1996. Self-complementary shapes as the term is used herein include those that have a closed area (area made with or including one or more materials, e.g., a conductor) that is congruent and complementary to an open area such that the open and closed areas can be brought into coincidence through a rigid motion such as offset (translation), reflection, or rotation. The open and closed areas can each be composite areas, i.e., they may have separate portions.

Figure 7:
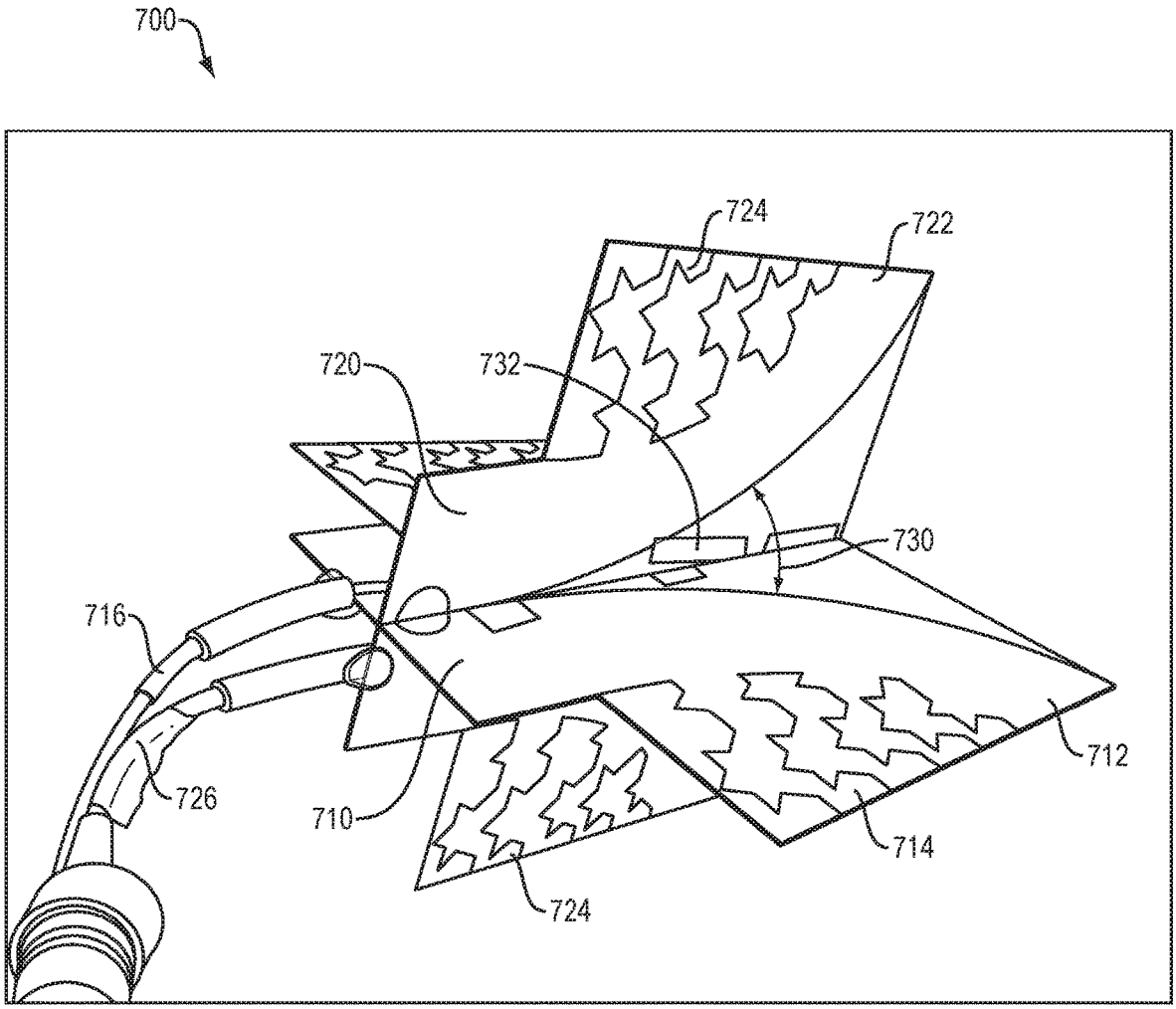
FIG. 7 depicts another example of a Vivaldi FPS antenna having a crossed configuration, in accordance with exemplary embodiments of the present disclosure.

FIG. 7 depicts a crossed configuration 700 of two separately fed Vivaldi FPS antennas, in accordance with an exemplary embodiment 700 of the present disclosure. The two Vivaldi FPS antennas 710 and 720 each incorporate fractal plasmonic surfaces, in this case configured as slots or areas defined by edges of conductive surfaces 712 and 722, respectively. It will be appreciated that in some embodiments, the FPS may be or include traces or areas, and not slots of substrate (i.e., slots removed from conductive surface). The dark features shown in this example, i.e., the conductive surfaces 712 and 722, are composed of conductive copper, which is disposed on an insulating substrate 713 and 723. Representative traces 714 and 724 are shown adjacent to non-conductive areas 715 and 725, which define the fractal resonators. Two separate feed lines 716 and 726 are shown. A support structure 732 may be present to facilitate placement of the two Vivaldi FPS antennas 710 and 720 in a crossed (e.g., orthogonal) configuration. Such a configuration can advantageously allow for orthogonally-polarized radiation to be accommodated (transmitted/received) by antenna 700. For the example shown, the frequency coverage was measured or determined to be 600 MHz-GHz, with the antenna structure fitting in a volume of approximately 10 inch by 10 inch by 10 inch. This compared very favorably to a conventional prior art Vivaldi horn of dimensions 19 by 14 by 14 inches used to obtain roughly the same performance.

Figure 8:
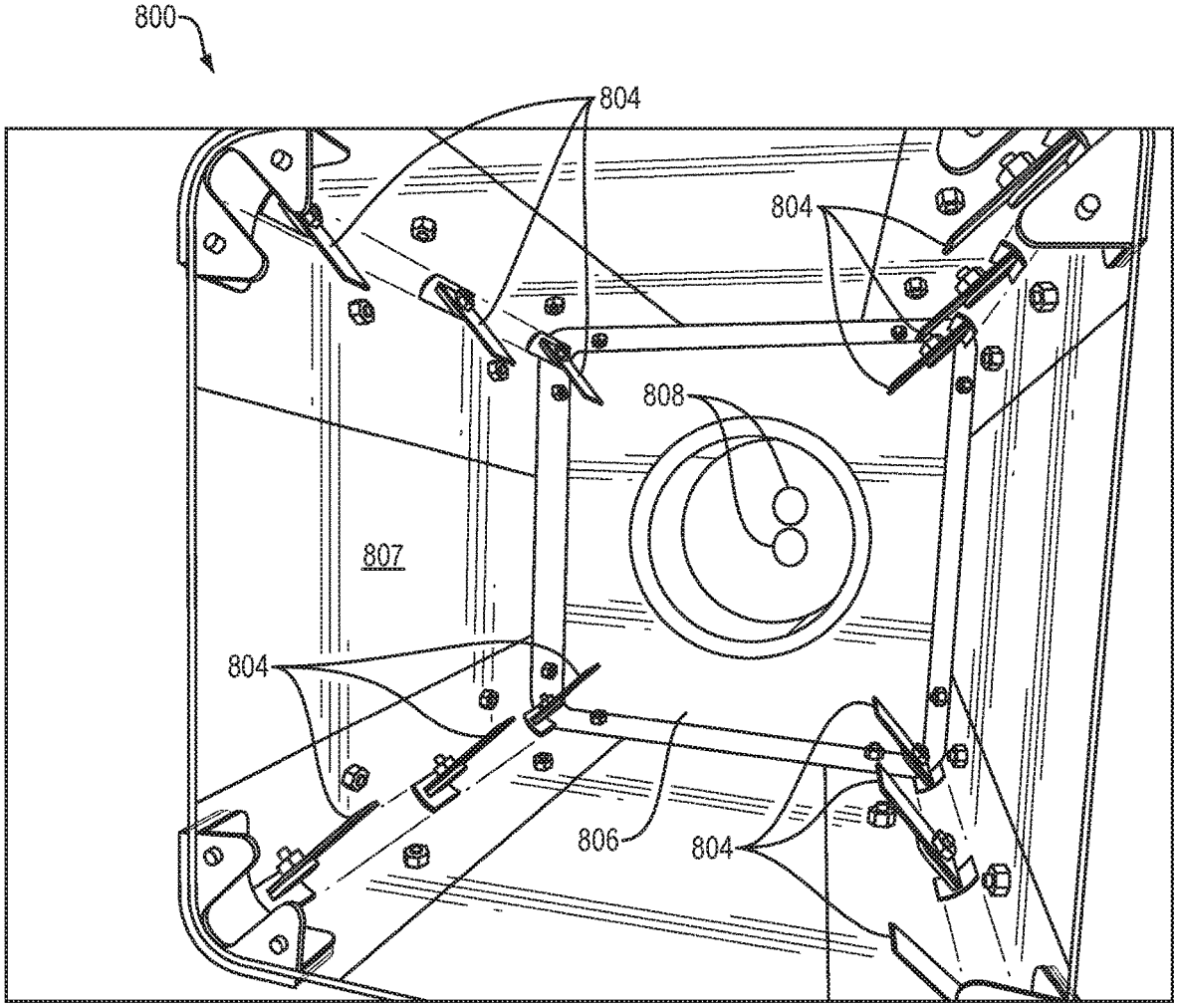
FIG. 8 depicts another example of a horn or cone used for a Vivaldi FPS antenna, in accordance with exemplary embodiments of the present disclosure.

As shown in FIG. 7, the two Vivaldi antennas shown can be separately fed and sandwiched, e.g., at right angles. Preferably they are then placed within a conductive cone which can serve as a waveguide, such as shown in FIG. 8. Other configurations, e.g., number of and angles between Vivaldi FPS antennas, are possible within the scope of the present disclosure/invention.

FIG. 8 depicts an example of a cone 800 that can be used with crossed Vivaldi FPS antenna according to the present disclosure. Cone 800 includes a housing surface 802 configured to hold a Vivaldi FPS antenna or antennas, e.g., crossed configuration 700 of FIG. 7. In exemplary embodiments, housing surface 802 may be configured as a truncated square pyramidal structure composed of multiple panels that are joined together, e.g., by suitable fasteners or welding or adhesives. In alternate embodiments, different forms on an enclosure can be used, e.g., a case, radome, etc. The interior of the cone 800 can include a number of securements 804 which are configured to hold a Vivaldi FPS antenna or antennas, e.g., crossed configuration 700 of FIG. 7. Space 806 is shown in addition to two ports 808 for separate feed lines.

Figure 9:
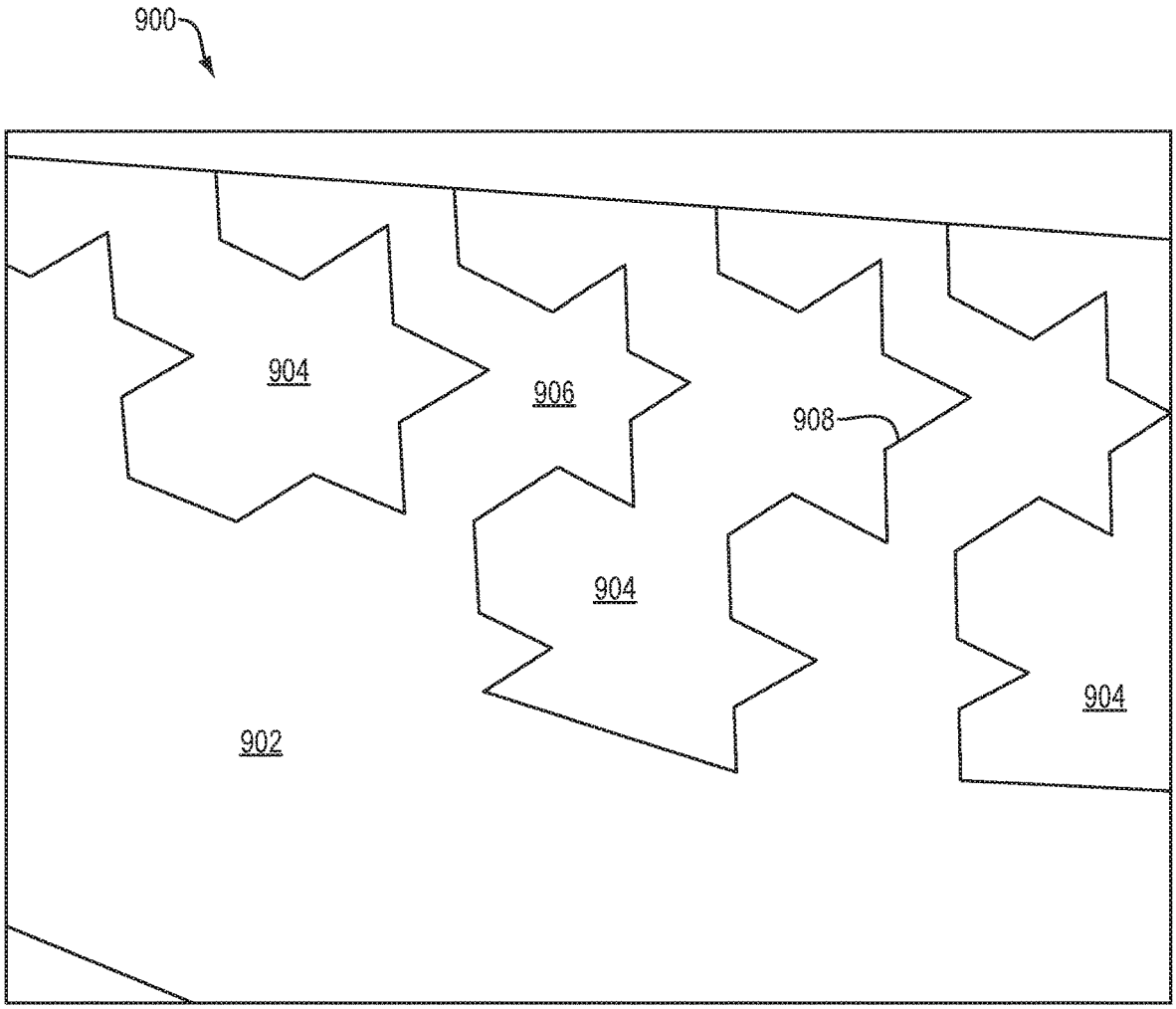
FIG. 9 depicts an example of substantially self-complementary fractal slots, in accordance with the present disclosure.
Figure 10A:
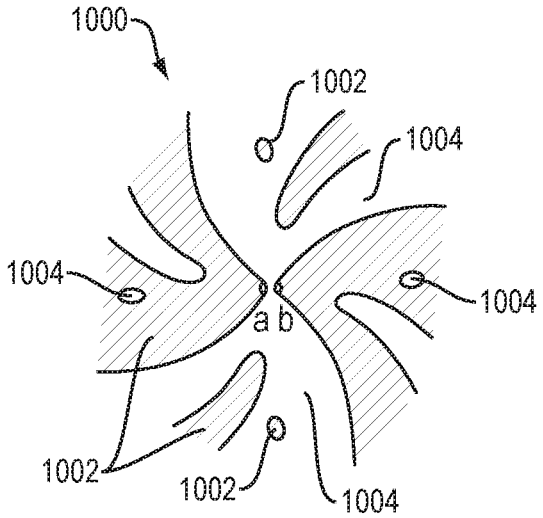
FIGS. 10A-10D depict examples of self-complementary antenna features, in accordance with the present disclosure.
Figure 10B:
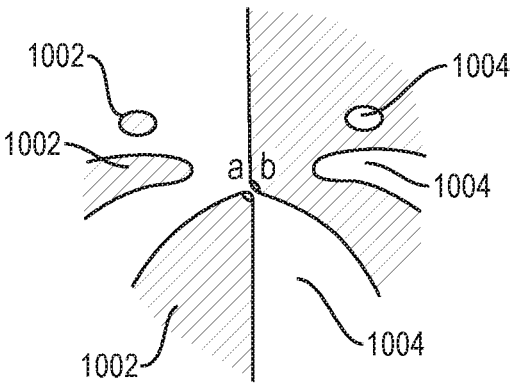
Figure 10C:
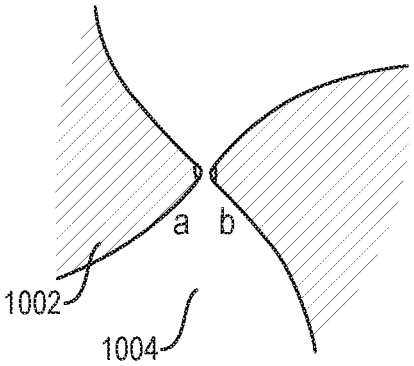
Figure 10D:
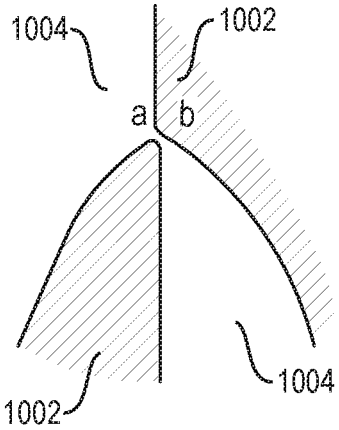

FIG. 9 shows examples of self-complementary or substantially self-complementary fractal features used for exemplary embodiments of the subject disclosure. Conductive material is shown as 902 and non-conductive material is shown as 904. Conductive fractal strip or trace 906 is shown adjacent to complementary non-conductive are 908, e.g., as used on or for a Vivaldi FPS slot antenna.

FIG. 10, which includes FIGS. 10A-10D, depicts examples 1000 of self-complementary shapes useful for embodiments of the present disclosure. Features (e.g., surfaces and/or three-dimensional shapes) that are self-complementary can be included in various aspects of the subject technology (e.g., embodiments according to the present disclosure). As shown in FIGS. 10A-D, shaded areas, e.g., 1002, can indicate surfaces or solid features that are covered with or include conductive material(s). Unshaded areas 1004 can refer to or indicate open areas, e.g., voids or areas without conductive material(s).

It will be appreciated that embodiments of Vivaldi FPS antenna according to the present disclosure can be utilized for telecommunications, including but not limited to commercial carrier "cell" type use, WIFI, LMR, FIRSTNET, and or additional public safety usage, or some combination of one or more of the above. Exemplary embodiments are operative for far-field use (as opposed to near-field).

Exemplary embodiments of Vivaldi FPS antenna can be designed to operate at desired frequency bands, including but not limited to 5G or 4G frequency bands between 600 and 6000 MHZ and additional 5G or 6G bands as desired. "Band" or "bands" can include reference to bandwidth of spectrum. Other bands of operation for embodiments of the present disclosure include, but are not limited to, any frequency ranges within 1 MHz to 100 GHz, e.g., a 5G frequency band within the frequency range of 24 GHz to 72 GHz.

It will be appreciated that exemplary embodiments of the present disclosure can include or provide for more than one Vivaldi FPS antenna in a casing, e.g., with at least two antennas nested along diagonals of a casing (e.g., radome).

Exemplary embodiments of the present disclosure can include or provide for one or more additional antennas along the sides of the casing.

Exemplary embodiments of the present disclosure can include or provide for a Vivaldi FPS antenna arrangement uses as or for a multiple port MIMO system.

Exemplary embodiments of the present disclosure can include or provide for a molded or 3D printed dielectric casing.

Exemplary embodiments of Vivaldi FPS antennas, including Vivaldi FPS horn antennas, may be attached to or on support structures within or on stadiums, street lights and poles, sign supports, signs, towers, municipal buildings, airports, commercial buildings, highway viewpoints, deployed in fields, deployed in houses of worship, and other venues of similar nature, e.g., where a large number of people may congregate.

While embodiments are shown and described herein as having shells in the shape of concentric rings (circular cylinders), shells can take other shapes in other embodiments. For example, one or more shells could have a generally spherical shape (with minor deviations for structural support). In an exemplary embodiment, the shells could form a nested arrangement of such spherical shapes, around an object to be shielded (at the targeted/selected frequencies/wavelengths). Shell cross-sections of angular shapes, e.g., triangular, hexagonal, while not preferred, may be used. While cards are described herein in the context of having fractal resonators, non-fractal resonators may be used within the scope of the present disclosure. Such cards may be considered as metamaterial cards.

One skilled in the art will appreciate that embodiments and/or portions of embodiments of the present disclosure can be implemented in/with computer-readable storage media (e.g., hardware, software, firmware, or any combinations of such), and can be distributed and/or practiced over one or more networks. Steps or operations (or portions of such) as described herein, including processing functions to derive, learn, or calculate formula and/or mathematical models utilized and/or produced by the embodiments of the present disclosure, can be processed by one or more suitable processors, e.g., central processing units ("CPUs") implementing suitable code/instructions in any suitable language (machine dependent or machine independent) and thus constitute a specially (specifically) designed computer or computer system.

While certain embodiments and/or aspects have been described herein, it will be understood by one skilled in the art that the methods, systems, and apparatus of the present disclosure may be embodied in other specific forms without departing from the spirit thereof.

For example, while certain wavelengths/frequencies of operation have been described, these are merely representative and other wavelength/frequencies may be utilized or achieved within the scope of the present disclosure.

Furthermore, while certain preferred fractal generator shapes have been described others may be used within the scope of the present disclosure. Accordingly, the embodiments described herein are to be considered in all respects as illustrative of the present disclosure and not restrictive.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

All articles, patents, patent applications, and other publications that have been cited in this disclosure are incorporated herein by reference.

The phrase "means for" when used in a claim is intended to and should be interpreted to embrace the corresponding structures and materials that have been described and their equivalents. Similarly, the phrase "step for" when used in a claim is intended to and should be interpreted to embrace the corresponding acts that have been described and their equivalents. The absence of these phrases from a claim means that the claim is not intended to and should not be interpreted to be limited to these corresponding structures, materials, or acts, or to their equivalents.

The scope of protection is limited solely by the claims that now follow. That scope is intended and should be interpreted to be as broad as is consistent with the ordinary meaning of the language that is used in the claims when interpreted in light of this specification and the prosecution history that follows, except where specific meanings have been set forth, and to encompass all structural and functional equivalents.

Relational terms such as "first" and "second" and the like may be used solely to distinguish one entity or action from another, without necessarily requiring or implying any actual relationship or order between them. The terms "comprises," "comprising," and any other variation thereof when used in connection with a list of elements in the specification or claims are intended to indicate that the list is not exclusive and that other elements may be included. Similarly, an element proceeded by an "a" or an "an" does not, without further constraints, preclude the existence of additional elements of the identical type.

None of the claims are intended to embrace subject matter that fails to satisfy the requirement of Sections 101, 102, or 103 of the Patent Act, nor should they be interpreted in such a way. Any unintended coverage of such subject matter is hereby disclaimed. Except as just stated in this paragraph, nothing that has been stated or illustrated is intended or should be interpreted to cause a dedication of any component, step, feature, object, benefit, advantage, or equivalent to the public, regardless of whether it is or is not recited in the claims.

The abstract is provided to help the reader quickly ascertain the nature of the technical disclosure. It is submitted with the understanding that it will not be used to interpret or limit the scope or meaning of the claims. In addition, various features in the foregoing detailed description are grouped together in various embodiments to streamline the disclosure. This method of disclosure should not be interpreted as requiring claimed embodiments to require more features than are expressly recited in each claim. Rather, as the following claims reflect, inventive subject matter lies in less than all features of a single disclosed embodiment. Thus, the following claims are hereby incorporated into the detailed description, with each claim standing on its own as separately claimed subject matter.

What is claimed is:

1. A Vivaldi fractal plasmonic surface (FPS) antenna comprising:

a first conductive surface disposed on a first substrate and defining a first tapered slot without conductive material, wherein the fir conductive surface includes conductive material on opposed first and second sides of the fir tapered slot; and a first plurality of fractal resonators disposed on the first and second sides of the fir tapered slot, wherein the first plurality of fractal resonators present a first fractal plasmonic surface (FPS), and wherein the first plurality of fractal resonators are defined by fractal slots in the first conductive surface.

2. The antenna of claim 1, wherein the antenna is configured to operate at a 4G frequency band.

3. The antenna of claim 1, wherein the antenna is configured to operate at a 5G frequency band.

4. The antenna of claim 1, wherein the antenna is configured to operate at a 6G frequency band.

5. The antenna of claim 1, wherein the first tapered slot has a logarithmic shape.

6. The antenna of claim 1, wherein the first tapered slot has an exponential shape.

7. The antenna of claim 1, wherein the first tapered slot has a parabolic shape.

8. The antenna of claim 1, wherein the first tapered slot has a hyperbolic shape.

9. The antenna of claim 1, wherein the first plurality of fractal cells includes fractal slots having a shape of a Koch curve.

10. The antenna of claim 1, wherein the fractal slots have an extent in a direction perpendicular to a longitudinal axis of the first tapered slot.

11. The antenna of claim 1, further comprising:

a second conductive surface disposed on a second substrate and defining a second tapered slot without conductive material, wherein the second conductive surface includes conductive material on opposed first and second sides of the second tapered slot;

a second plurality of fractal resonators disposed on the first and second sides of the second tapered slot, wherein the second plurality of fractal resonators present a second fractal plasmonic surface (FPS).

12. The antenna of claim 11, wherein the first and second conductive surfaces are arranged in a crossed configuration.

13. The antenna of claim 11, wherein the first and second conductive surfaces are disposed within a conductive casing.

14. The antenna of claim 11, wherein the first and second conductive surfaces are fed by separate feed lines.

15. The antenna of claim 13, further comprising one or more additional antennas disposed along sides of the conductive casing.

16. The antenna of claim 11, wherein the antenna is configured as a multiple-port MIMO system.

17. The antenna of claim 13, wherein the conductive casing includes a dielectric material.

18. The antenna of claim 1, wherein the first FPS is configured for operation at a frequency band of 600-10,000 MHz.

19. A Vivaldi fractal plasmonic surface (FPS) antenna comprising:

a first conductive surface disposed on a first substrate and defining a first tapered slot without conductive material, wherein the first conductive surface includes conductive material on opposed first and second sides of the first tapered slot; and a first plurality of fractal resonators disposed on the first and second sides of the first tapered slot, wherein the first plurality of fractal resonators present a first fractal plasmonic surface (FPS), and wherein the first plurality of fractal resonators are defined by fractal slots in the first conductive surface;

a second conductive surface disposed on a second substrate and defining a second tapered slot without conductive material, wherein the second conductive surface includes conductive material on opposed first and second sides of the second tapered slot; and a second plurality of fractal resonators disposed on the first and second sides of the second tapered slot, wherein the second plurality of fractal resonators present a second fractal plasmonic surface (FPS);

wherein the first and second FPSs are configured for operation at a 5G frequency band within the frequency range of 24 GHz to 72 GHz.

* * * * *